US006700543B2

(12) United States Patent
Konishi et al.

(10) Patent No.: US 6,700,543 B2
(45) Date of Patent: Mar. 2, 2004

(54) ANTENNA ELEMENT WITH CONDUCTORS FORMED ON OUTER SURFACES OF DEVICE SUBSTRATE

(75) Inventors: Takayoshi Konishi, Tokyo (JP); Masashi Ikeda, Miyagi (JP); Kazuo Minegishi, Miyagi (JP)

(73) Assignees: NEC Tokin Corporation, Miyagi (JP); NEC Microwave Tube, Ltd., Kanagawa-ken (JP)

( * ) Notice: Subject to any disclaimer, the term of this patent is extended or adjusted under 35 U.S.C. 154(b) by 0 days.

(21) Appl. No.: 10/131,462

(22) Filed: Apr. 25, 2002

(65) Prior Publication Data

US 2002/0190907 A1 Dec. 19, 2002

(30) Foreign Application Priority Data

Jun. 15, 2001 (JP) ..... 2001-181815

(51) Int. Cl.[7] ..... H01Q 1/38

(52) U.S. Cl. ..... 343/700 MS; 343/702; 343/848

(58) Field of Search ..... 343/700 MS, 702, 343/829, 846, 848

(56) References Cited

U.S. PATENT DOCUMENTS 5,748,149 A * 5/1998 Kawahata ..... 343/700 MS
5,760,746 A * 6/1998 Kawahata ..... 343/702
5,861,854 A * 1/1999 Kawahata et al. ..... 343/702

* cited by examiner

*Primary Examiner*—Dong Wong
*Assistant Examiner*—Shih-Chao Chen
(74) *Attorney, Agent, or Firm*—Young & Thompson

(57) ABSTRACT

An antenna element has parallel first conductor and second conductor connected by a short-circuit conductor to form a loaded inductance. A ground conductor is also formed on an outer surface of a device substrate which is formed with a conductive line comprised of the first conductor, second conductor and short-circuit conductor. The ground conductor has a terminate end connected to the conductive line, and is applied with a ground potential at a leading end. Since the ground conductor functions in a manner similar to a conventional short pin, the antenna element can provide a radiation resistance twice as much.

13 Claims, 7 Drawing Sheets

ANTENNA ELEMENT WITH CONDUCTORS FORMED ON OUTER SURFACES OF DEVICE SUBSTRATE

BACKGROUND OF THE INVENTION

1. Field of the Invention

The present invention relates to an antenna element for use in reception or transmission of radio waves, and more particularly, to an antenna element which has conductors formed on outer surfaces of a device substrate.

2. Description of the Related Art

At present, radio communication apparatuses called a mobile telephone and the like are pervasive in general users, and a reduction in size and weight is required for the radio communication apparatuses. The radio communication apparatus receives and transmits radio waves through an antenna element, where the total length of a conductive line is closely related to the wavelength of a radio wave transmitted or received thereby.

For this reason, since a simple reduction in the length of the conductive line causes a rise in the resonant frequency, difficulties are encountered in efficiently radio communicating a radio wave at a predetermined frequency. To address this problem, a variety of techniques have been devised for reducing the shape of an overall antenna element while maintaining a required resonant frequency.

For example, an antenna element called a helical antenna has a conductive line formed in a spiral shape, while an antenna element called a meander antenna has a conductive line in a meandering shape. While these antennas do not achieve a reduction in the total length of the conductive line, the overall shape can be substantially reduced.

There is also an antenna element called a dielectric antenna which has a conductive line formed on the surface of a dielectric material to reduce the length of the conductive line. Since the wavelength of a radio wave is reduced within a member having a high dielectric constant or permeability, the formation of the conductive line on or within a dielectric material or a magnetic material results in a reduction in the total length thereof.

Moreover, there is an antenna element called a loaded antenna which adds a reactance element, an inductance element or a capacitance element to a conductive line to reduce the length of the conductive line. It should be understood that a variety of foregoing techniques may be combined to create, for example, an antenna element which has a conductive line formed in a helical shape or in a meander shape on the surface of a dielectric material.

In another technique, a ground electrode is connected to a conductive line of an antenna element by a short pin to generate a current through the short pin in opposite phase to that in the conductive line in an opposite direction. Since the opposite phase current generated in the opposite direction in this manner can be regarded as an in-phase current generated in the same direction, a radiation resistance of the antenna element can be increased as a result.

A variety of techniques as described above permit an improvement in the performance of antenna elements without uselessly increasing the size thereof. However, in the helical antenna and meander antenna, a long conductive line is bent to reduce the area occupied thereby, so that adjacent portions of the conductive line are electromagnetically coupled to cause an increase in surface current and high frequency loss.

To solve the problem as mentioned, the present inventor invented an antenna element which has a conductive line formed in a shape different from the helical shape or meander shape on the surface of a dielectric material, and filed the invention as Japanese Patent Application No. 2001-026002. This application discloses an antenna element which has a first conductor and a second conductor, parallel to each other, connected by a short-circuit conductor to form a loaded inductance.

Referring now to FIGS. 1 and 2, the antenna element disclosed in the above-cited application will be described below in brief, as a related art which precedes the present invention and is not known. The antenna element described below was filed in Japan on Feb. 1, 2001 as Japanese Patent Application No. 2001-026002, and filed in the United States of America on Jan. 31, 2002 as U.S. Ser. No. 10/059423 by the present inventor. However, this application has not been opened in any country, so that this is not a prior art but merely a related art of the present invention.

Antenna element 100 in the aforementioned application has device substrate 101 made of a dielectric material, and conductive line 102 formed of a printed wire on a front surface and a bottom surface of device substrate 101. Conductive line 102 is comprised of power supply conductor 103, first conductor 104, short-circuit conductor 105, and second conductor 106, each of which is linearly formed in succession.

More specifically, power supply conductor 103 of conductive line 102 comprises a linear portion formed from the bottom surface to the front surface of device substrate 101, while first conductor 104 comprises a linear portion formed from an upper end which is a terminate end of power supply conductor 103 and bent at a right angle to the right in the figure. Short-circuit conductor 105 comprises a linear portion formed from a right end which is a terminate end of first conductor 104 and bent upward at a right angle in the figure, i.e., in the opposite direction to power supply conductor 103, while second conductor 106 comprises a linear portion formed from an upper end which is a terminate end of short-circuit conductor 105 and bent at a right angle to the left in the figure, and positioned in parallel to first conductor 104.

Then, antenna apparatus 200 using antenna element 100 as described above comprises a circuit board 201 made of glass epoxy resin, ethylene tetrafluoride or the like, as illustrated in FIG. 2. A copper foil is adhered in a lower half and the like of a front surface of circuit board 201 to form a ground electrode 202.

Ground electrode 202 is partially formed with a recess in which power supply electrode 204 is formed for power supply circuit 203 (for example, a coaxial cable) which serves as a power supply means. Then, antenna element 100 is mounted on an upper half of the front surface of circuit board 201 on which ground electrode 202 is not formed. Power supply conductor 103 is connected to power supply electrode 204.

In antenna element 100 of the structure as described above, conductive line 102 can be reduced in length since first conductor 104 and second conductor 106, positioned in parallel to each other, act as a loaded inductance. In addition, since conductive line 102 is generally bent in an inverted C-shape, the overall shape can be reduced in size.

Unlike the meander antenna, helical antenna and the like, in spite of the reduction in size, first conductor 104 and second conductor 106, positioned in parallel to each other, are sufficiently spaced away from each other, so that their electromagnetic coupling is reduced, thereby making it possible to realize radio communications with a high gain, high efficiency and wide band.

In antenna element 100, since short-circuit conductor 105 mainly transmits and receives radio waves, the transmission/reception have a directivity in the horizontal direction in the figure orthogonal to the longitudinal direction of the short-circuit conductor 105. For this reason, if a conductor such as ground electrode 202 is positioned in a direction orthogonal to short-circuit conductor 105, the conductor will impede the transmission/reception of radio waves through short-circuit conductor 105.

To solve the foregoing problem, it is contemplated to avoid forming ground electrode 202 and the like in the direction orthogonal to short-circuit conductor 105. However, this solution would cause a reduction in the area of ground electrode 202 available for mounting circuit parts (not shown). In other words, it is necessary to minimize an antenna mounting area on which ground electrode 202 is not formed in order to maximize an area available for mounting circuit parts.

SUMMARY OF THE INVENTION

It is an object of the present invention to provide a highly efficient antenna element which is capable of minimizing an antenna mounting area in a structure which has a first conductor and a second conductor positioned in parallel to each other and connected through a short-circuit conductor.

Similarly to the aforementioned related art, an antenna element of the present invention includes a device substrate and a conductive line which is comprised of at least a power supply conductor, a first conductor, a short-circuit conductor, and a second conductor. The device substrate is made of at least one of a dielectric material and a magnetic material, and is formed with the power supply conductor, first conductor, short-circuit conductor, and second conductor. The power supply conductor is made of a linear conductor, and supplied with electric power at a leading end thereof. The first conductor is connected to a terminate end of the power supply conductor at a right angle, while the short-circuit conductor is connected to a terminate end of the first conductor at a right angle on the opposite side of the power supply conductor. The second conductor is connected to a terminate end of the short-circuit conductor at a right angle, and positioned in parallel to the first conductor.

In the antenna element of the present invention as described above, the device substrate is also formed with a ground conductor which has a terminate end connected to the conductive line, and a leading end applied with a ground potential.

Since this structure allows the ground conductor to function in a manner similar to a conventional short-pin, the antenna element can have an increased radiation resistance. Also, impedance matching can be adjusted by changing reactance and/or resistance of input impedance of the conductive line. The resonance frequency can also be adjusted by a position at which the ground conductor is connected to the conductive line. Further, the performance can be improved in the antenna element which includes a loaded inductance formed of the parallel first and second conductors.

In another implementation of the antenna element as described above, a capacitive conductor having a given capacitance is formed as part of the conductive line, and connected to a terminate end of the second conductor. Thus, the conductive line can be reduced in length by a loaded capacitance of the capacitive conductor, so that the antenna element can be reduced in size.

The ground conductor has a terminate end electromagnetically coupled to the conductive line in non-contact manner. Since the electromagnetic coupling eliminates the need for directly connecting the ground conductor to the conductive line, the ground conductor can be readily formed.

A first antenna apparatus according to the present invention includes an antenna element, a circuit board, a ground electrode, and a ground wire. The antenna element includes the antenna element according to the present invention, and the circuit board has the antenna element mounted on a front surface thereof. The ground electrode is formed at a position spaced apart from the antenna element on the front surface of the circuit board for generating a ground potential. The ground wire is formed on the front surface of the circuit board, and has a leading end connected to the ground electrode, and a terminate end connected to a leading end of the ground conductor.

A second antenna apparatus according to the present invention includes a device substrate, a conductor line, a circuit board, a ground electrode, and a ground wire. The conductive line is comprised of a power supply conductor, a first conductor, a short-circuit conductor, and a second conductor. The device substrate is made of at least one of a dielectric material and a magnetic material, and is formed with the power supply conductor, first conductor, short-circuit conductor, and second conductor. The power supply conductor is made of a linear conductor, and is supplied with electric power with a leading end thereof. The first conductor is connected at a right angle to a terminate end of the power supply conductor, while the short-circuit conductor is connected at a right angle to a terminate end of the first conductor on the opposite side of the power supply conductor. The second conductor is connected at a right angle to a terminate end of the short-circuit conductor, and positioned in parallel to the first conductor. The circuit board is mounted with the device substrate on a front surface thereof. The ground electrode is formed at a position spaced apart from the device substrate on the front surface of the circuit board for generating a ground potential. The ground wire is formed on the front surface of the circuit board, and has a leading end connected to the ground electrode, and a terminate end connected to a leading end of the ground conductor.

In the antenna apparatus of the present invention configured as described above, since the ground potential at the ground electrode is applied to the ground conductor of the antenna element through the ground wire, the ground conductor of the antenna element can function in a manner similar to a conventional short pin.

In another implementation of the antenna apparatus as described above, a capacitive conductor having a given capacitance is connected to a terminate end of the second conductor and additionally formed as part of the conductive line. Thus, the conductive line can be reduced in length by a loaded capacitance of the capacitive conductor, making it possible to reduce the antenna apparatus as well as the antenna element in size.

Also, since the ground conductor has a terminate end electromagnetically coupled to the conductive line in non-contact manner, the ground conductor need not be directly connected to the conductive line. Consequently, the ground conductor, for example, may be formed only on the front surface of he circuit board without extending to the antenna element, thereby facilitating the formation of the ground conductor.

A third antenna apparatus according to the present invention includes a conductive line, a device substrate, a circuit board, a ground electrode, a power supply electrode, and a ground wire. The device substrate is made of at least one of a dielectric material and a magnetic material, and is formed with the conductive line. The circuit board is mounted with the device substrate on a front surface thereof. The ground electrode is formed at a position spaced apart from the device substrate on a front surface of the circuit board for generating a ground potential. On the front surface of the circuit board, the power supply electrode has a terminate end connected to the conductive line on the device substrate, and is supplied with electric power at a leading end. The ground wire, which is formed on the front surface of the circuit board, has a leading end connected to the ground electrode, and a terminate end connected to the power supply electrode.

As appreciated from the foregoing, since the ground potential at the ground electrode is applied to the power supply electrode through the ground wire in the antenna apparatus according to the present invention, the ground wire functions in a manner similar to a conventional short pin. In addition, the present invention can provide a reduction in the entire size of the antenna apparatus, as well as a wider bandwidth and a higher efficiency for the same.

The above and other objects, features and advantages of the present invention will become apparent from the following description with reference to the accompanying drawings which illustrate examples of the present invention.

DETAILED DESCRIPTION OF THE PREFERRED EMBODIMENTS

One embodiment of the present invention will hereinafter be described with reference to FIGS. 3 and 4. It should be first noted however that with respect to the following embodiment, parts identical to those of antenna element 100 and antenna apparatus 200 described above are designated by the same names, and detailed description thereon is omitted.

Also, while in the following embodiments, directions such as front and back, right and left, and up and down are referred to in correspondence to the drawings, these directions are used for convenience of simplifying the description and do not at all limit the directions in actual manufacturing and use of associated products.

Figure 1:
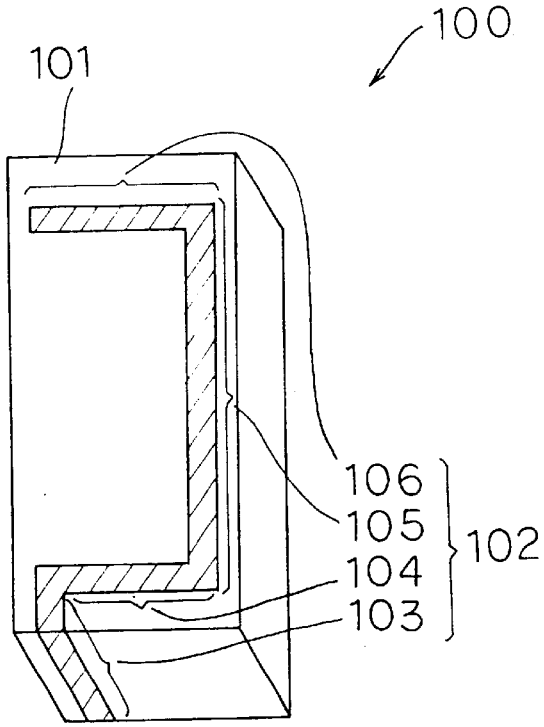
Fig.1(Related Art)
FIG. 1 is a perspective view illustrating an antenna element according to an unknown related art, invented by the present inventor.
Figure 2:
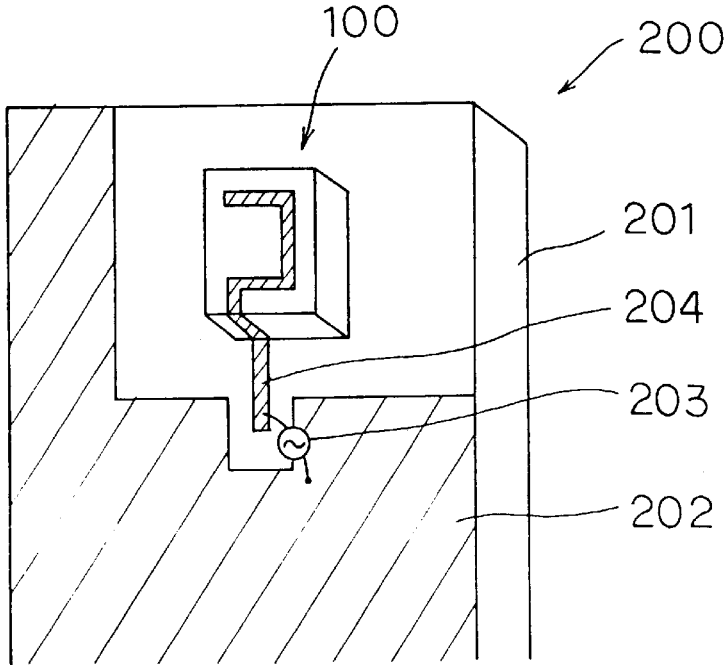
Fig.2(Related Art)
FIG. 2 is a perspective view illustrating an antenna apparatus according to an unknown related art, invented by the present inventor.
Figure 3:
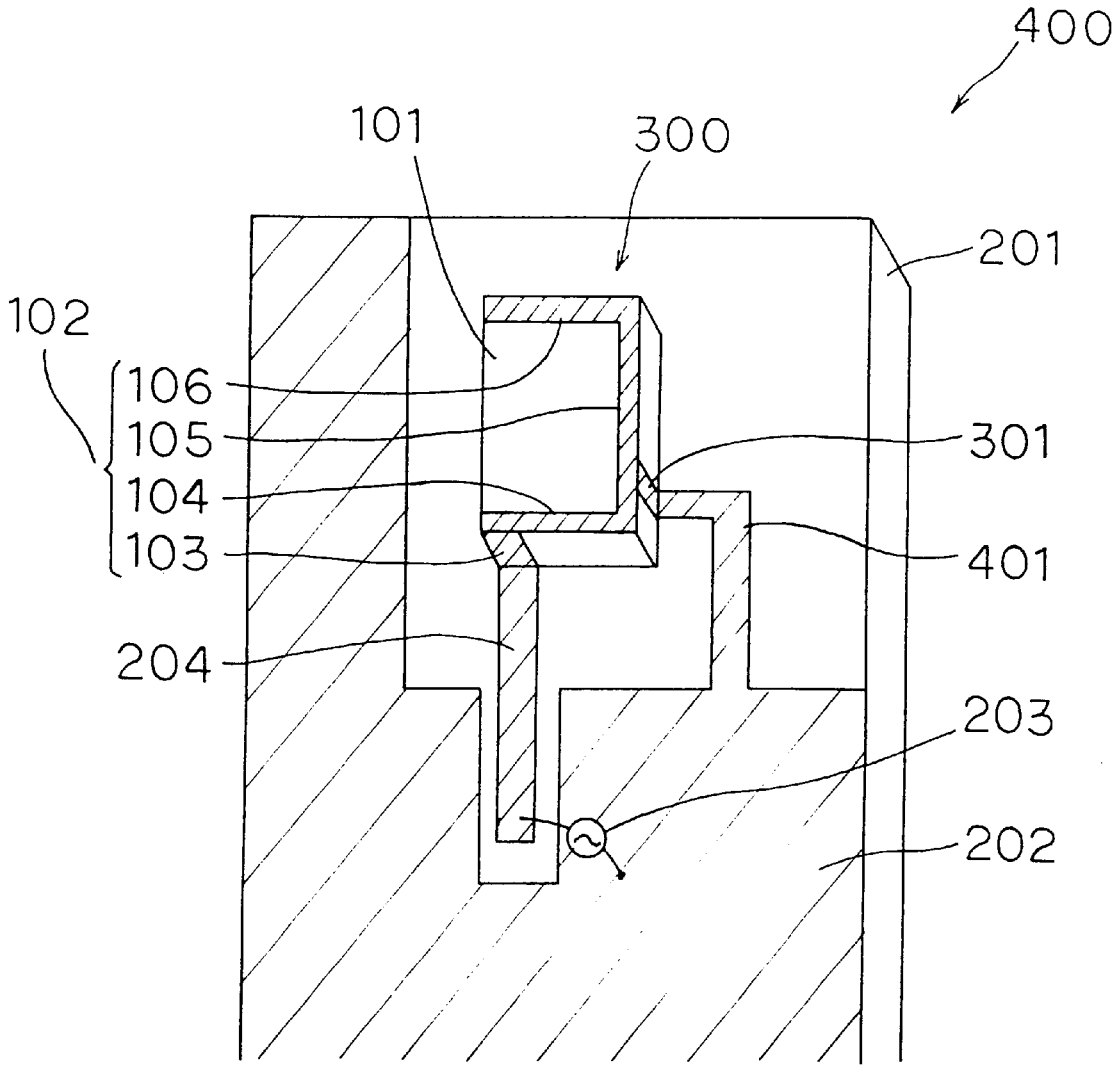
FIG. 3 is a perspective view illustrating an antenna apparatus according to one embodiment of the present invention.

Referring to FIG. 3, like the aforementioned antenna element 100, antenna element 300 in this embodiment comprises device substrate 101 made of a dielectric material, and conductive line 102 on front and bottom surfaces of device substrate 101. Conductive line 102 is comprised of a power supply conductor 103, first conductor 104, short-circuit conductor 105, and second conductor 106.

Similarly, like the aforementioned antenna apparatus 200, antenna apparatus 400 in this embodiment has ground electrode 202 in a lower half and the like of a front surface of circuit board 201, and power supply electrode 204 of power supply circuit 203, serving as a power supply means, formed in a recess of ground electrode 202.

Antenna element 300 is mounted in an upper half of the front surface of circuit board 201 on which ground electrode 202 is not formed. Power supply conductor 103 of antenna element 300 is connected to power supply electrode 204.

However, unlike the aforementioned antenna element 100, antenna element 300 in this embodiment additionally has ground conductor 301 formed on a side surface of device substrate 101. Ground conductor 301 is connected to conductive line 102.

More specifically, ground conductor 301 has a terminate end connected near a leading end of short-circuit conductor 105, and a leading end positioned on the boundary of a side surface and a rear surface of device substrate 101.

Then, unlike the aforementioned antenna apparatus 200, antenna apparatus 400 in this embodiment has ground wire 401 on the front surface of circuit board 201. Ground wire 401 has a leading end connected to ground electrode 202.

Since ground wire 401 has a terminate end connected to a leading end of ground conductor 301 of antenna element 300, a ground potential at ground electrode 202 is applied to ground conductor 301 of antenna element 300 through ground wire 401.

In the foregoing structure, antenna element 300 in this embodiment is similar to the aforementioned antenna element 100 in that first conductor 104 and second conductor 106 positioned in parallel to each other act as a loaded inductance, so that the length of conductive line 102 is reduced to make the overall shape smaller, while ensuring a desired resonant frequency.

Unlike the meander antenna, helical antenna and the like, in spite of the reduction in shape, first conductor 104 and second conductor 106 positioned in parallel to each other are sufficiently spaced apart from each other, so that their electromagnetic coupling is reduced, making it possible to realize radio communications with a high gain, high efficiency, and wide band.

In antenna apparatus 400 in this embodiment, however, ground conductor 301 is connected at a predetermined position of conductive line 102 of antenna element 300, so that ground conductor 301 is applied with the ground potential at ground electrode 202 through ground wire 401.

Thus, ground conductor 301 can function as a conventional short pin to increase a radiation resistance of antenna element 300, so that impedance matching can be adjusted by changing reactance and/or resistance of input impedance of conductive line 102.

In other words, since improved performance can be achieved for antenna element 300 which uses parallel first conductor 104 and second conductor 106 as a loaded inductance, antenna element 300 can transmit and receive radio waves relatively satisfactorily even if a conductor such as ground electrode 202 is positioned in a direction orthogonal to short-circuit conductor 105.

For this reason, since ground electrode 202 can be placed relatively close to antenna element 300 even if ground electrode 202 is positioned in the direction orthogonal to short-circuit conductor 105, antenna apparatus 400 can be reduced in size without the need for reducing ground electrode 202 in a downward or a lateral direction in the figure.

The present invention is not limited to the foregoing embodiment, but a variety of alterations are permitted without departing from the spirit and scope of the invention. For example, in antenna element 300 illustrated in the foregoing embodiment, conductive line 102 is comprised of power supply conductor 103, first conductor 104, short-circuit conductor 105 and second conductor 106. Alternatively, as antenna elements 501–503 illustrated in FIGS. 4*a*–4*c*, capacitive conductors 507–509 having given capacitances may be added as parts of conductive lines 504–506.

Figures 4A, 4B, 4C:
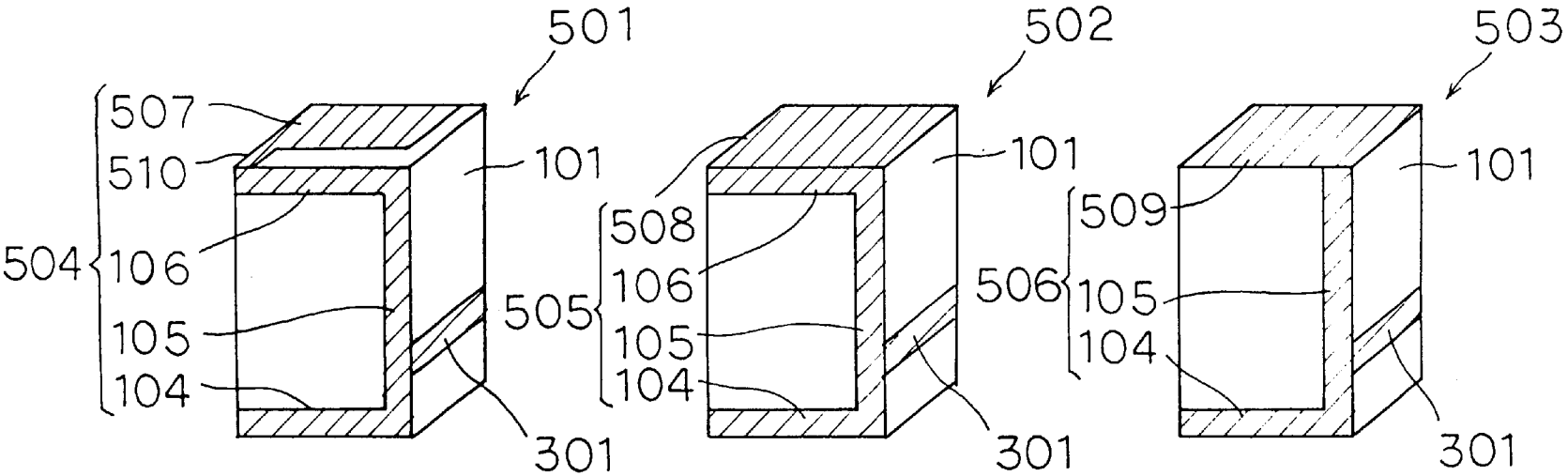
FIGS. 4*a*–4*c* are perspective views illustrating several exemplary modifications to the antenna element.

In this event, as antenna element 501 illustrated in FIG. 4*a*, connection conductor 510 formed on the top surface of device substrate 101 may have a leading end connected to a terminate end of second conductor 106 on the front surface, and capacitive conductor 507 likewise formed on the top surface of device substrate 101 may be connected to a terminate end of connection conductor 510.

Also, as antenna element 502 illustrated in FIG. 4*b*, capacitive conductor 508 formed over the entire top surface of device substrate 101 may be connected directly to second conductor 106. Further, as antenna element 503 illustrated in FIG. 4*c*, capacitive conductor 509 formed over the entire top surface of device substrate 101 may be used as second conductor 106.

As noted, the capacitances of capacitive conductors 507–509 as mentioned above are generated between capacitive conductors 507–509 and ground electrode 202, so that the capacitances of capacitive conductors 507–509 vary depending on their sizes and shapes, relationships with ground electrode 202 in distance and shape, and the like.

For actually forming capacitive conductors 507–509, the capacitances are adjusted corresponding to the resonant frequencies of conductive lines 504–506 by a computer simulation or the like.

Since antenna elements 501–503 as described above provide a reduction in resonant frequency by virtue of loaded capacitances of capacitive conductors 507–509, antenna elements 501–503 can be reduced in overall shape, with reduced conductive lines 504–506, without relatively increasing the resonant frequency.

Also, since illustrative antenna apparatus 400 in the foregoing embodiment adjusts impedance matching by changing reactance and resistance of input impedance of conductive line 102, ground conductor 301 of antenna element 300, to which ground wire 401 is connected, is connected near a leading end of short-circuit conductor 105.

Figure 5:
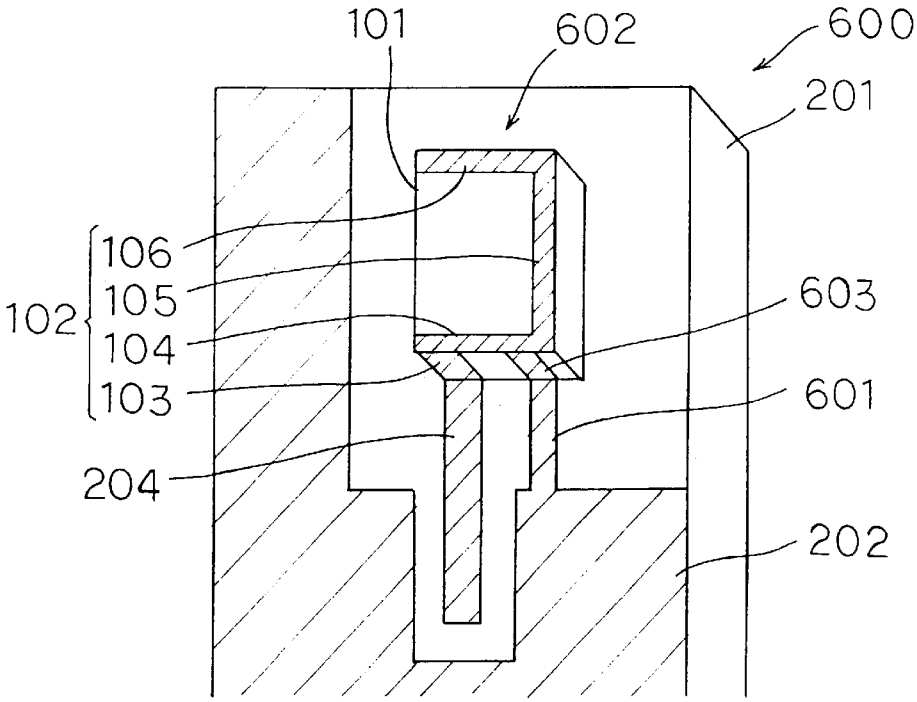
FIG. 5 is a perspective view illustrating a first exemplary modification to the antenna apparatus.
Figure 6:
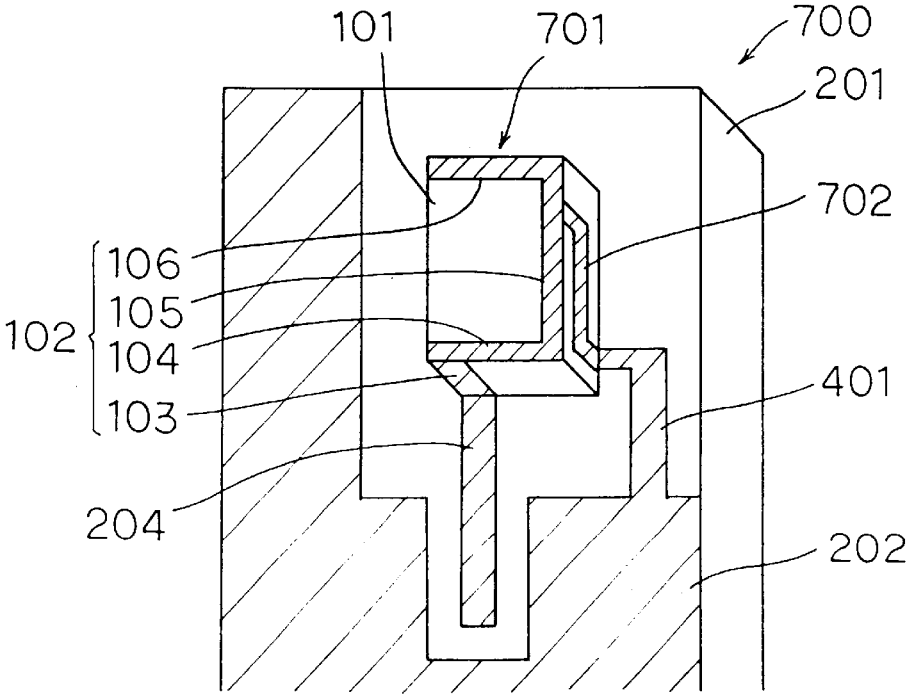
FIG. 6 is a perspective view illustrating a second exemplary modification.

However, as antenna apparatus 600 illustrated in FIG. 5, ground conductor 603 of antenna element 602, to which ground conductor 601 is connected, may be connected to first conductor 104. Further alternatively, as antenna apparatus 700 illustrated in FIG. 6, ground conductor 702 of antenna element 701 may be connected near a terminate end of short-circuit conductor 105.

Since antenna apparatus 600, 700 as described above has a pass of current defined by a path extending from a leading end of power supply electrode 204 to a terminate end of conductive line 102 and turning back to a leading end of ground wire 601, 401, the resonant frequency can be adjusted by changing the position of conductive line 102 at which ground conductor 603, 702 is connected, and the lengths of ground wire/conductor 601, 603, 401, 702.

Figure 7:
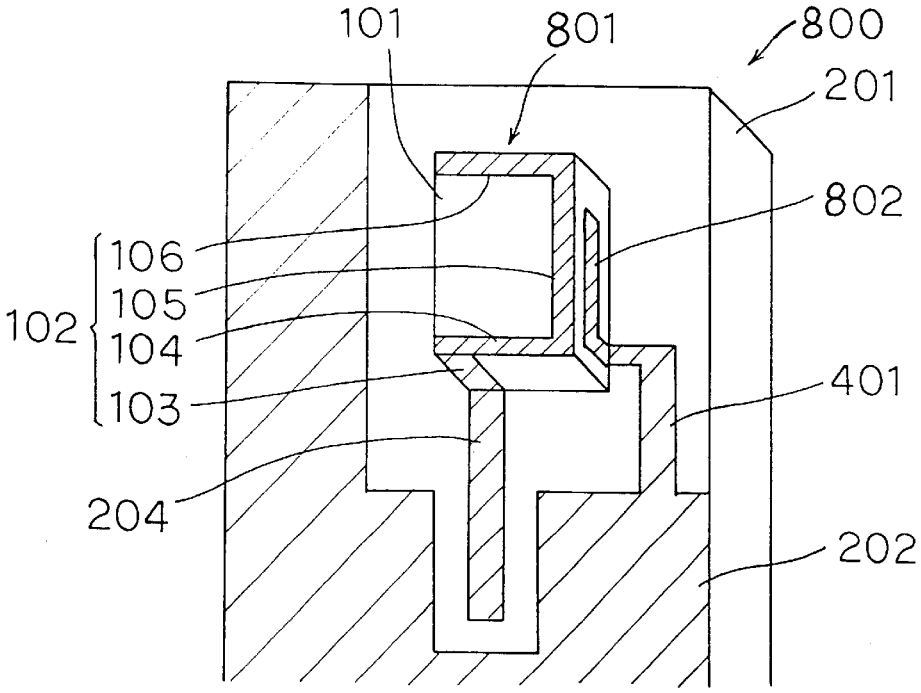
FIG. 7 is a perspective view illustrating a third exemplary modification.

While antenna apparatus 400 in the foregoing embodiment illustrates ground conductor 301 of antenna element 300 directly connected to conductive line 102, ground conductor 802 of antenna element 801 may be electromagnetically coupled to conductive line 102 in non-contact manner, as antenna apparatus 800 illustrated in FIG. 7.

Figure 8:
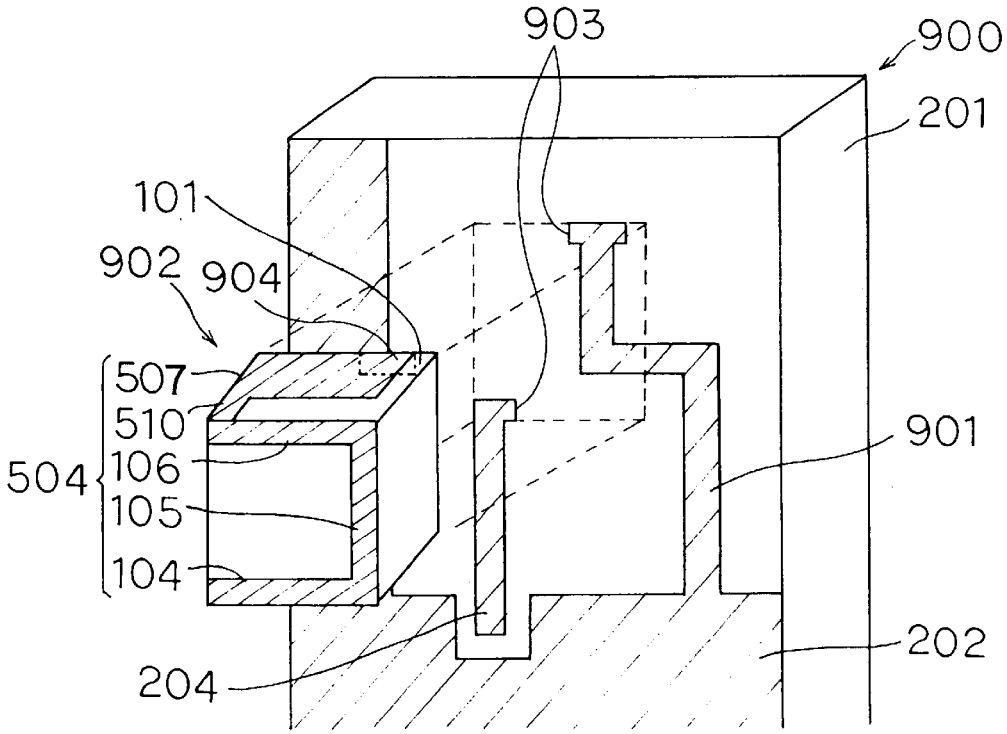
FIG. 8 is an exploded perspective view illustrating a fourth exemplary modification.

Further, while antenna apparatus 400 in the foregoing embodiment illustrates that ground conductor 301 connected to conductive line 102 is also formed in antenna element 300, ground wire 901 formed only on the front surface of circuit board 201 may be connected to conductive line 504 of antenna element 902, as antenna apparatus 900 illustrated in FIG. 8.

Particularly, since this antenna apparatus 900 has capacitive conductor 507 formed on the top surface of antenna element 902, ground wire 901 is readily connected to capacitive conductor 507. In addition, when ground wire 901 is connected to a terminate end of conductive line 504 in this manner, conductive line 504 and ground wire 901 can function as a folded antenna.

Connection 903 is formed integrally with terminate ends of power supply electrode 204 and ground wire 901, and connection 904 in the same shape is also formed integrally with power supply conductor 103 and capacitive conductor 507 on a back surface of antenna element 902.

These connections 903, 904 are connected by soldering to electrically connect power supply conductor 103 to power supply electrode 204, electrically connect capacitive conductor 507 to ground wire 901, and secure antenna element 902 integrally with circuit board 201.

Figure 9:
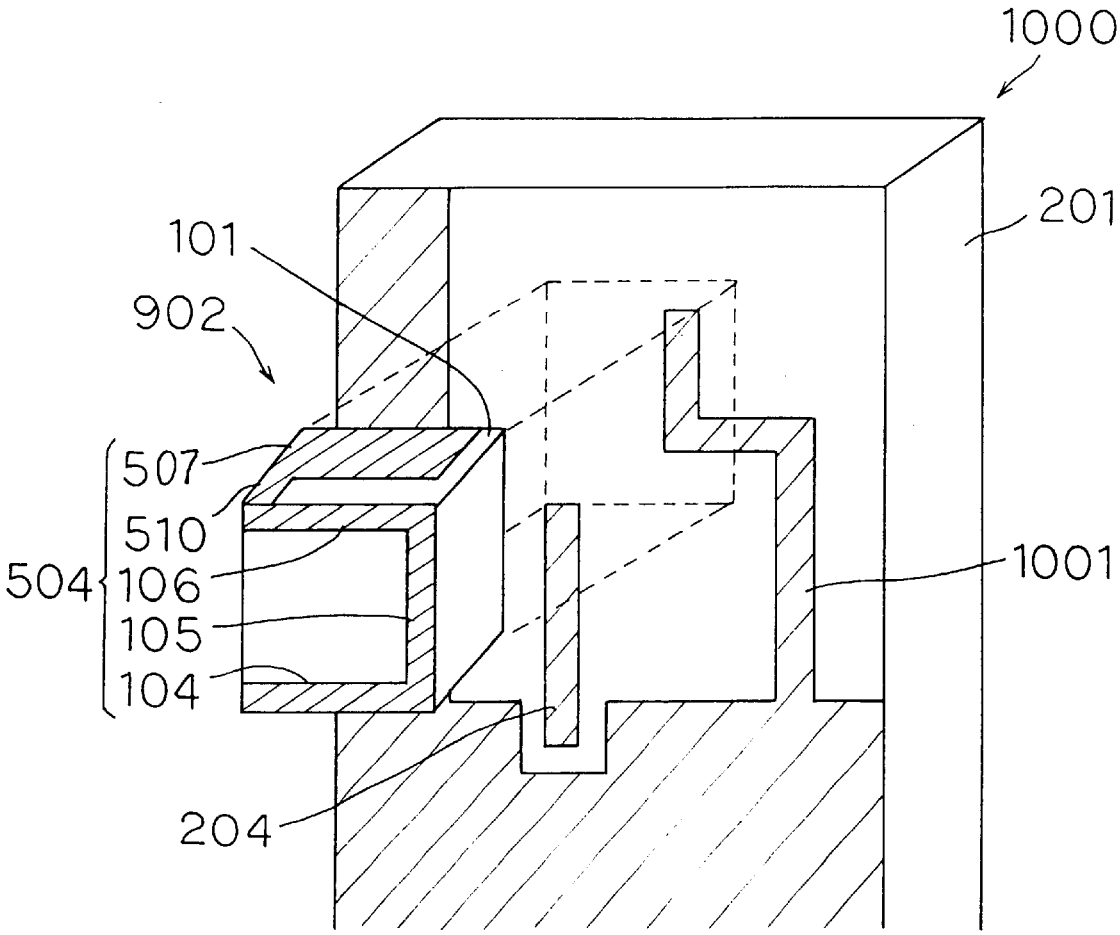
FIG. 9 is an exploded perspective view illustrating a fifth exemplary modification.

As antenna apparatus 1000 illustrated in FIG. 9, ground wire 1001 formed only on the front surface of circuit board 201 may be electromagnetically coupled to conductive line 504 of antenna element 902 in non-contact manner.

In this configuration, antenna apparatus 1000 can be readily manufactured because ground wire 1001 formed on circuit board 201 need not be directly connected to conductive line 504 formed on device substrate 101.

While power supply conductor 103 is not illustrated in FIGS. 8 and 9, it is actually formed on the bottom surface of device substrate 101 and connected to power supply electrode 204, as is the case with FIG. 3 and other figures.

Figure 10:
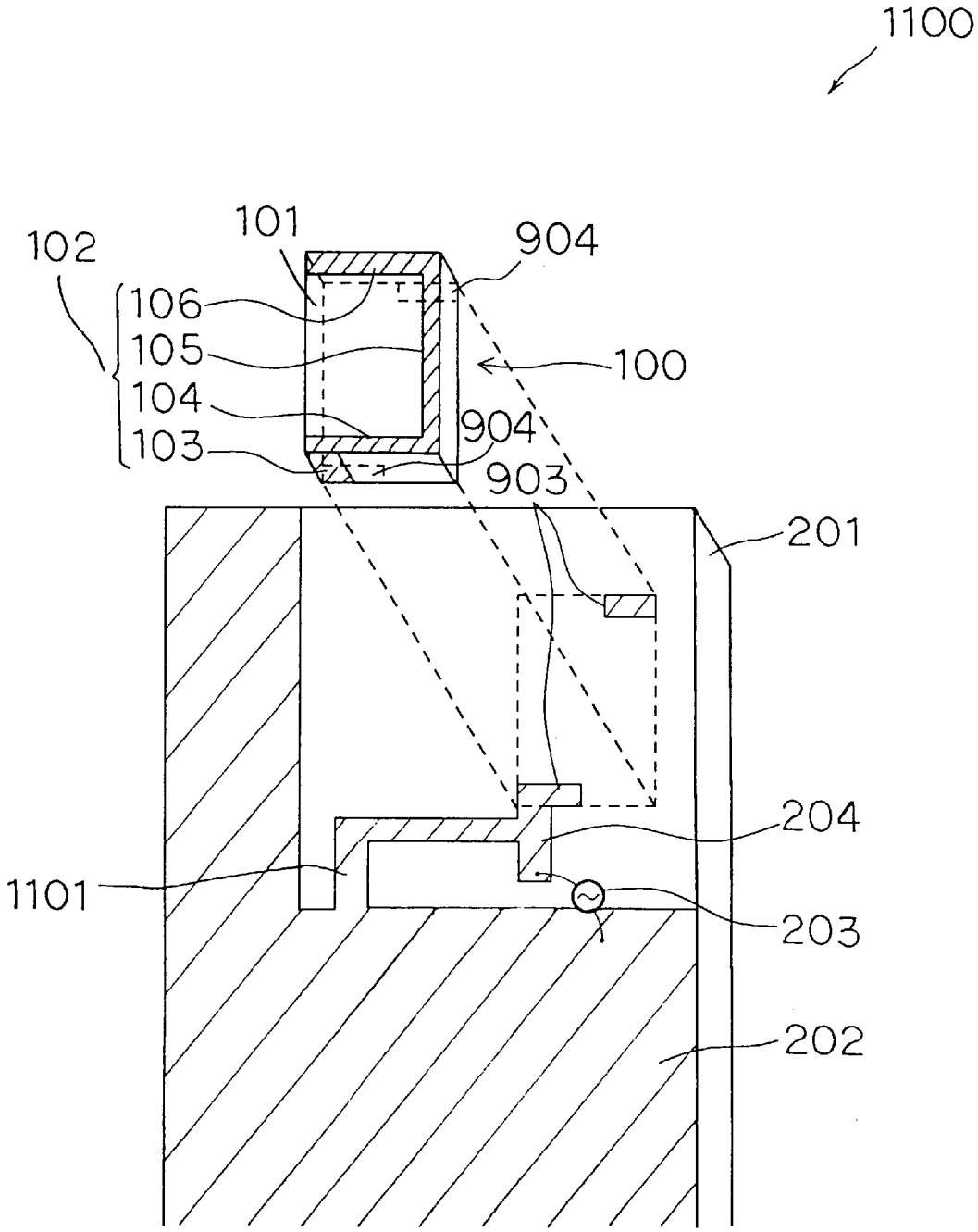
FIG. 10 is an exploded perspective view illustrating a sixth exemplary modification.

In addition, since power supply electrode 204 connected to conductive line 102 of antenna element 100 also functions as an antenna line, ground wire 1101 formed on the surface of circuit board 201 may be connected to power supply electrode 204 formed on the surface of circuit board 201, as antenna apparatus 1100 illustrated in FIG. 10.

In this configuration, such antenna apparatus 1100 readily provides a reduction in resonant frequency, an increase in bandwidth and radiation efficiency, and the like by forming longer ground wire 1101, and defining a position at which ground wire 1101 is connected in close proximity to a leading end of power supply electrode 204.

Further, since the formation of ground wire 1101 longer than power supply electrode 204 results in an increased antenna length and resulting reduction in resonant frequency, as described above, the whole apparatus can be relatively reduced in size. Provided that antenna apparatus 1100 has a lower resonant frequency in this manner, conductive line 102 may be made wider to increase the bandwidth.

Moreover, since no ground conductor need be formed in antenna element 1100 and power supply electrode 204 can be formed integrally with ground wire 1101, antenna apparatus 1100 can be simplified in structure.

The foregoing structure in which ground wire 1101 is connected to power supply electrode 204 on the surface of circuit board 201 may be applied to a conventional dielectric antenna which does not comprise parallel first conductor 104 and second conductor 106.

While one each of ground conductor 301 and ground wire 401 are provided in antenna element 300 and the like in the foregoing illustrative embodiment, a plurality of these elements may be provided. Since antenna element 300 functions similarly to a folded antenna by the action of ground conductor 301 and ground wire 401, an increase in the number of ground conductor 301 and ground wire 401 can result in an increased radiation resistance and an improved radiation efficiency. Alternatively, the radiation resistance can be increased to improve the radiation efficiency by increasing line widths of ground conductor 301 and ground wire 401.

While preferred embodiment(s) of the present invention has (have) been described using specific terms, such description is for illustrative purposes only, and it is to be understood that changes and variations may be made without departing from the spirit or scope of the following claims.

What is claimed is:

1. An antenna element comprising:

a power supply conductor made of a linear conductor and supplied with electric power at a leading end thereof;

a first conductor directly connected at a right angle to a terminate end of said power supply conductor;

a short-circuit conductor directly connected at a right angle to a terminate end of said first conductor, and positioned on an opposite side of said power supply conductor;

a second conductor directly connected at a right angle to a terminate end of said short-circuit conductor and positioned in parallel to said first conductor;

a device substrate made of at least one of a dielectric material and a magnetic material and formed with a continuous conductive line comprised of at least said power supply conductor, said first conductor, said short-circuit conductor, and said second conductor; and a ground conductor formed on said device substrate, and having a terminate end connected to said conductive line and a leading end applied with a ground potential.

2. The antenna element according to claim 1, further comprising a capacitive conductor having a given capacitance, said capacitive conductor being connected to a terminate end of said second conductor and formed as part of said conductive line.

3. The antenna element according to claim 1, wherein said ground conductor has the terminate end electromagnetically coupled to said conductive line in non-contact manner.

4. The antenna element according to claim 1, wherein said ground conductor has a terminate end directly connected to said conductive line.

5. An antenna apparatus comprising:

an antenna element with, a power supply conductor made of a linear conductor and supplied with electric power at a leading end thereof;

a first conductor connected at a right angle to a terminate end of said power supply conductor;

a short-circuit conductor connected at a right angle to a terminate end of said first conductor, and positioned on an opposite side of said power supply conductor;

a second conductor connected at a right angle to a terminate end of said short-circuit conductor and positioned in parallel to said first conductor;

a device substrate made of at least one of a dielectric material and a magnetic material and formed with a continuous conductive line comprised of at least said power supply conductor, said first conductor, said short-circuit conductor, and said second conductor; and a ground conductor formed on said device substrate, and having a terminate end connected to said conductive line and a leading end applied with a ground potential;

said antenna apparatus further comprising, a circuit board, said antenna element being mounted on a front surface of said circuit board;

a ground electrode formed on the front surface of said circuit board at a position spaced apart from said antenna element for generating a ground potential; and a ground wire formed on the front surface of said circuit board, and having a leading end connected to said ground electrode and a terminate end connected to a leading end of said ground conductor.

6. An antenna apparatus comprising:

a power supply conductor made of a linear conductor and supplied with electric power at a leading end thereof;

a first conductor connected at a right angle to a terminate end of said power supply conductor;

a short-circuit conductor connected at a right angle to a terminate end of said first conductor, and positioned on an opposite side of said power supply conductor;

a second conductor connected at right angle to a terminate end of said short-circuit conductor and positioned in parallel to said first conductor;

a device substrate made of at least one of a dielectric material and a magnetic material and formed with a conductive line comprised of at least said power supply conductor, said first conductor, said short-circuit conductor, and said second conductor;

a circuit board, said device substrate being mounted on a front surface of said circuit board;

a ground electrode formed on the front surface of said circuit board at a position spaced apart from said device substrate for generating a ground potential; and a ground wire formed on the front surface of said circuit board and having a leading end connected to said ground electrode and a terminate end connected to said conductive line.

7. The antenna apparatus according to claim 6, further comprising a capacitive conductor having a given capacitance, said capacitive conductor being connected to a terminate end of said second conductor and formed as part of said conductive line.

8. The antenna apparatus according to claim 6, wherein said ground wire has a terminal end electromagnetically coupled to said conductive line in non-contact manner.

9. The antenna apparatus according to claim 6, wherein said ground wire has a terminal end directly connected to said conductive line.

10. An antenna apparatus comprising:

a continuous conductive line made of a linear conductor and supplied with electric power at a leading end thereof;

a device substrate made of at least one of a dielectric material and a magnetic material and formed with said conductive line;

a circuit board, said device substrate being mounted on a front surface of said circuit board;

a ground electrode formed on the front surface of said circuit board at a position spaced apart from said device substrate for generating a ground potential;

a power supply electrode formed on a front surface of said circuit board, and having a terminate end directly connected to said continuous conductive line of said device substrate, and a leading end supplied with electric power; and a ground wire formed on the front surface of said circuit board, and having a leading end connected to said ground electrode and a terminate end connected to said power supply electrode.

11. A radio communication apparatus comprising:

the antenna apparatus according to claim 5;

power supply means for supplying electric power to the power supply conductor of said antenna apparatus; and signal transmitting means for feeding a transmission signal to the conductive line of said antenna apparatus.

12. A radio communication apparatus comprising:

the antenna apparatus according to claim 5;

power supply means for supplying electric power to the power supply conductor of said antenna apparatus; and signal receiving means for acquiring a received signal from the conductive line of said antenna apparatus.

13. A radio communication apparatus comprising:

the antenna apparatus according to claim 5;

power supply means for supplying electric power to the power supply conductor of said antenna apparatus;

signal transmitting means for feeding a transmission signal to the conductive line of said antenna apparatus; and signal receiving means for acquiring a received signal from the conductive line of said antenna apparatus.

* * * * *